United States Patent [19]

Ernsthausen

[11] 4,121,133

[45] Oct. 17, 1978

[54] DIELECTRIC FOR MULTIPLE GASEOUS DISCHARGE DISPLAY/MEMORY PANEL HAVING IMPROVED VOLTAGE CHARACTERISTICS

[75] Inventor: Roger E. Ernsthausen, Lucky, Ohio

[73] Assignee: Owens-Illinois, Inc., Toledo, Ohio

[21] Appl. No.: 385,740

[22] Filed: Aug. 9, 1973

Related U.S. Application Data

[60] Division of Ser. No. 293,817, Oct. 2, 1972, which is a continuation-in-part of Ser. No. 60,376, Aug. 3, 1970, abandoned.

[51] Int. Cl.[2] ..... H01J 1/90

[52] U.S. Cl. ..... 313/518; 252/63.5; 252/63.2

[58] Field of Search ..... 252/63, 63.2, 63.5; 313/518

[56] References Cited

U.S. PATENT DOCUMENTS

| | | | |
|---|---|---|---|
| 2,716,190 | 8/1955 | Baker | 252/63.5 |
| 2,934,683 | 3/1960 | Durst et al. | 252/63.5 |

*Primary Examiner*—John D. Welsh

*Attorney, Agent, or Firm*—Donald K. Wedding; Click; David H. Wilson

[57] ABSTRACT

There is disclosed a multiple gaseous discharge display memory panel having an electrical memory and capable of producing a visual display, the panel being characterized by an ionizable gaseous medium in a gas chamber formed by a pair of opposed dielectric material charge storage members which are respectively backed by an array of electrode (conductor) members such that each array of electrode members is insulated from the gaseous medium by a dielectric member, the electrode members behind each dielectric material member being oriented with respect to the electrode members behind the opposing dielectric material member so as to define a plurality of discrete discharge volumes, each discharge volume constituting a discharge unit, the dielectric material being selectively enriched with at least one Group IA or IIA element in an amount sufficient to provide operating voltages which are substantially uniform and which do not significantly change with time.

6 Claims, 5 Drawing Figures

Figure 1:
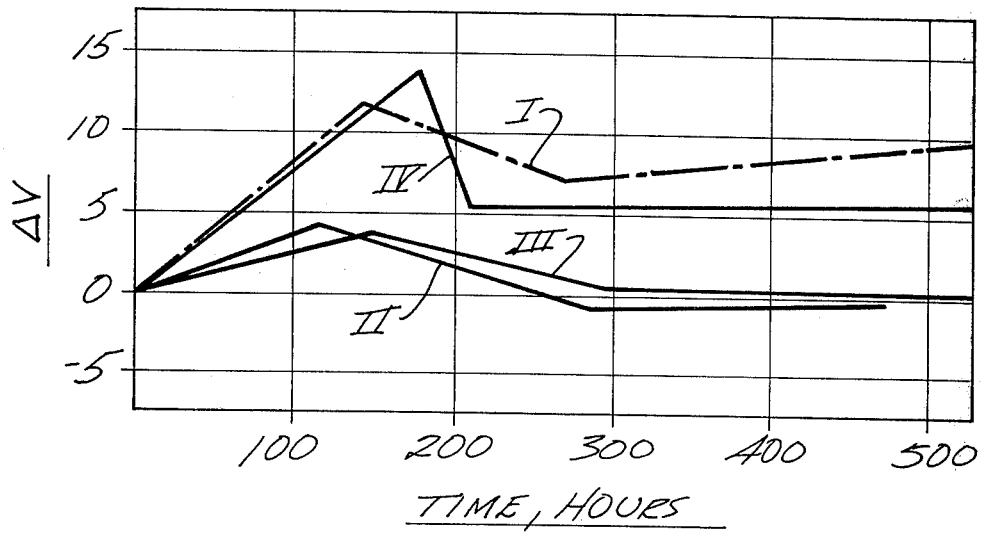

I- STO
II- $Na_2O$
III- $Na_2O$
IV- $Cs_2O$

DIELECTRIC FOR MULTIPLE GASEOUS DISCHARGE DISPLAY/MEMORY PANEL HAVING IMPROVED VOLTAGE CHARACTERISTICS

RELATED APPLICATIONS:

This is a division of copending U.S. patent application Ser. No. 293,817, filed Oct. 2, 1972, which is a continuation in part of copending United States patent application Ser. No. 60,376, filed Aug. 3, 1970, now abandoned.

THE INVENTION

This invention relates to novel multiple gas discharge display/memory panels which have an electrical memory and which are capable of producing a visual display or representation of data such as numerals, letters, television display, radar displays binary words, etc. More particularly, this invention relates to novel gas discharge display/memory panels having substantially uniform operating voltages; that is, essentially stable as a function of operating time. As used herein, voltage is defined as any voltage required for operation of the panel including firing and sustaining voltages as well as any other voltages for manipulation of the discharge.

Multiple gas discharge display and/or memory panels of one particular type with which the present invention is concerned are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member typically being appropriately oriented so as to define a plurality of discrete gas discharge units or cells.

In some prior art panels the discharge cells are additionally defined by surrounding or confining physical structure such as apertures in perforated glass plates and the like so as to be physically isolated relative to other cells. In either case, with or without the confining physical structure, charges (electrons, ions) produced upon ionization of the elemental gas volume of a selected discharge cell, when proper alternating operating potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting an electrical memory.

Thus, the dielectric layers prevent the passage of substantial conductive current from the conductor members to the gaseous medium and also serve as collecting surfaces for ionized gaseous medium charges (electrons, ions) during the alternate half cycles of the A.C. operating potentials, such charges collecting first on one elemental or discrete dielectric surface area and then on an opposing elemental or discrete dielectric surface area on alternate half cycles to constitute an electrical memory.

An example of a panel structure containing non-physically isolated or open discharge cells is disclosed in U.S. Letters Pat. No. 3,499,167 issued to Theodore C. Baker, et al.

An example of a panel containing physically isolated cells is disclosed in the article by D. L. Bitzer and H. G. Slottow entitled "The Plasma Display Panel — A Digitally Addressable Display With Inherent Memory", Proceeding of the Fall Joint Computer Conference, IEEE, San Francisco, California, Nov. 1966, pages 541–547. Also reference is made to U.S. Letters Pat. No. 3,559,190.

In the construction of the panel, a continuous volume of ionizable gas is confined between a pair of dielectric surfaces backed by conductor arrays typically forming matrix elements. The cross conductor arrays may be orthogonally related (but any other configuration of conductor arrays may be used) to define a plurality of opposed pairs of charge storage areas on the surfaces of the dielectric bounding or confining the gas. Thus, for a conductor matrix having H rows and C columns the number of elemental discharge cells will be the product $H \times C$ and the number of elemental or discrete areas will be twice the number of such elemental discharge cells.

In addition, the panel may comprise a so-called monolithic structure in which the conductor arrays are created on a single substrate and wherein two or more arrays are separated from each other and from the gaseous medium by at least one insulating member. In such a device the gas discharge takes place not between two opposing electrodes, but between two contiguous or adjacent electrodes on the same substrate; the gas being confined between the substrate and an outer retaining wall.

It is also feasible to have a gas discharge device wherein some of the conductive or electrode members are in direct contact with the gaseous medium and the remaining electrode members are appropriately insulated from such gas, i.e., at least one insulated electrode.

In addition to the matrix configuration, the conductor arrays may be shaped otherwise. Accordingly, while the preferred conductor arrangement is of the crossed grid type as discussed herein, it is likewise apparent that where a maximal variety of two dimensional display patterns is not necessary, as where specific standardized visual shapes (e.g., numerals, letters, words, etc.) are to be formed and image resolution is not critical, the conductors may be shaped accordingly, i.e., a segmented display.

The gas is one which produces visible light or invisible radiation which stimulates a phosphor (if visual display is an objective) and a copious supply of charges (ions and electrons) during discharge.

In prior art, a wide variety of gases and gas mixtures have been utilized as the gaseous medium in a gas discharge device. Typical of such gases include CO; $CO_2$; halogens; nitrogen; $NH_3$; oxygen; water vapor; hydrogen; hydrocarbons; $P_2O_5$; boron fluoride, acid fumes; $TiCl_4$; Group VIII gases; air; $H_2O_2$; vapors of sodium, mercury, thallium, cadmium, rubidium, and cesium; carbon disulfide, laughing gas; $H_2S$; deoxygenated air; phosphorus vapors; $C_2H_2$; $CH_4$; naphthalene vapor; anthracene; freon; ethyl alcohol; methylene bromide; heavy hydrogen; electron attaching gases; sulfur hexafluoride, tritium; radioactive gases; and the rare or inert gases.

In one preferred embodiment hereof the medium comprises at least one rare gas, more preferably at least two, selected from helium, neon, argon, krypton, or xenon.

In an open cell Baker, et al. type panel, the gas pressure and the electrical field are sufficient to laterally confine charges generated on discharge within elemental or discrete dielectric areas within the perimeter of such areas, especially in a panel containing non-isolated discharge cells. As described in the Baker, et al. patent, the space between the dielectric surfaces occupied by the gas is such as to permit photons generated on discharge in a selected discrete or elemental volume of gas to pass freely through the gas space and strike surface areas of dielectric remote from the selected discrete volumes, such remote, photon struck dielectric surface areas thereby emitting electrons so as to condition at least one elemental volume other than the elemental volume in which the photons originated.

With respect to the memory function of a given discharge panel, the allowable distance or spacing between the dielectric surfaces depends, inter alia, on the frequency of the alternating current supply, the distance typically being greater for lower frequencies.

While the prior art does disclose gaseous discharge devices having externally positioned electrodes for initiating a gaseous discharge, sometimes called "electrodeless discharge", such prior art devices utilized frequencies and spacing or discharge volumes and operating pressures such that although discharges are initiated in the gaseous medium, such discharges are ineffective or not utilized for charge generation and storage at high frequencies; although charge storage may be realized at lower frequencies, such charge storage has not been utilized in a display/memory device in the manner of the Bitzer-Slottow or Baker, et al. invention.

The term "memory margin" is defined herein as $$M.\,M. = V_f - V_E/V_f/2$$

where $V_f$ is the half amplitude of the smallest sustaining voltage signal which results in a discharge every half cycle, but at which the cell is not bi-stable and $V_E$ is the half amplitude of the minimum applied voltage sufficient to sustain discharges once initiated. Other but similar memory margin definitions have been utilized in the prior art.

It will be understood that the basic electrical phenomenon utilized in this invention is the generation of charges (ions and electrons) alternately storable at pairs of opposed or facing discrete points or areas on a pair of dielectric surfaces backed by conductors connected to a source of operating potential. Such stored charges result in an electrical field opposing the field produced by the applied potential that created them and hence operate to terminate ionization in the elemental gas volume between opposed or facing discrete points or areas of dielectric surface. The term "sustain a discharge" means producing a sequence of momentary discharges, at least one discharge for each half cycle of applied alternating sustaining voltage, once the elemental gas volume has been fired, to maintain alternate storing of charges at pairs of opposed discrete areas on the dielectric surfaces.

As used herein, a cell is in the "on state" when a quantity of charge is stored in the cell such that on each half cycle of the sustaining voltage, a gaseous discharge is produced.

In addition to the sustaining voltage, other voltages may be utilized to operate the panel, such as firing, addressing, and writing voltages.

A "firing voltage" is any voltage, regardless of source, required to discharge a cell. Such voltage may be completely external in origin or may be comprised of internal cell wall voltage in combination with externally originated voltages.

An "addressing voltage" is a voltage produced on the panel X - Y electrode coordinates such that at the selected cell or cells, the total voltage applied across the cell is equal to or greater than the firing voltage whereby the cell is discharged.

A "writing voltage" is an addressing voltage of sufficient magnitude to ensure that on subsequent sustaining voltage half cycles, the cell will be in the on state.

In the operation of a multiple gaseous discharge device, of the type described hereinbefore, it is necessary to condition the discrete elemental gas volume of each discharge cell by supplying at least one free electron thereto such that a gaseous discharge can be initiated when the cell is addressed with an appropriate voltage signal.

The prior art has disclosed and practiced various means for conditioning gaseous discharge cells.

One such means of panel conditioning comprises a so-called electronic process whereby an electronic conditioning signal or pulse is periodically applied to all of the panel discharge cells, as disclosed for example in British patent specification No. 1,161,832, page 8, lines 56 to 76. Reference is also made to U.S. Letters Pat. No. 3,559,190 and "The Device Characteristics of the Plasma Display Element" By Johnson, et al., IEEE Transactions On Electron Device, September, 1971. However, electronic conditioning is self-conditioning and is only effective after a discharge cell has been previously conditioned; that is, electronic conditioning involves periodically discharging a cell and is therefore a way of maintaining the presence of free electrons. Accordingly, one cannot wait too long between the periodically applied conditioning pulses since there must be at least one free electron present in order to discharge and condition a cell.

Another conditioning method comprises the use of external radiation, such as flooding part or all of the gaseous medium of the panel with ultraviolet radiation. This external conditioning method has the obvious disadvantage that it is not always convenient or possible to provide external radiation to a panel, especially if the panel is in a remote position. Likewise, an external UV source requires auxiliary equipment. Accordingly, the use of internal conditioning is generally preferred.

One internal conditioning means comprises using internal radiation, such as by the inclusion of a radioactive material.

Another means of internal conditioning, which we call internal "photon conditioning", comprises using one or more so-called pilot discharge cells in the on state for the generation of photons. This is particularly effective in a so-called open cell construction (as described in the Baker, et al. patent) wherein the space between the dielectric surfaces occupied by the gas is such as to permit photons generated on discharge in a selected discrete or elemental volume of gas (discharge cell) to pass freely through the panel gas space so as to condition other and more remote elemental volumes of other discharge units. In addition to or in lieu of the pilot cells, one may use other sources of photons internal to the panel.

In accordance with this invention, it has been surprisingly discovered that the voltage uniformity as a function of operating time of a gaseous discharge panel may be significantly enhanced and improved by the selective addition of at least one Group IA or IIA element to the dielectric material. More particularly, at least one element selected from Group IA or IIA is selectively added into the panel dielectric material before curing in an amount sufficient to provide gaseous discharge panel operating voltages which are uniform and which do not significantly vary or substantially change over a given period of operating time.

As used herein Group IA element is defined as including lithium, sodium, potassium, rubidium, cesium, and francium; Group IIA element is defined herein as including beryllium, magnesium, calcium, strontium, barium, and radium. In the practice of this invention it is contemplated that one or more members of Group IA or IIA may be used alone or in combination. Likewise, mixtures of elements from both Group IA and IIA may be used. Possible combinations of elements include Na and Ca; Na and Mg; Na and Cs; Ca and Ra.

The Group IA or IIA element may be incorporated into the dielectric by any suitable means, typically by mixing with the dielectric material batch. Other suitable means of incorporation include not by way of limitation ion exchange, ion implantation, and diffusion techniques.

Any source of Group IA or IIA element may be utilized. It is broadly contemplated incorporating into the dielectric at least one Group IA or IIA member in elemental form or as a compound or mineral. Where the dielectric material is prepared as a glass batch, the Group IA or IIA is typically utilized in the form of an oxide or carbonate. However, dependent upon the method of incorporation of the Group IA or IIA member into the dielectric, other compounds may also be used.

Thus, typical sources of potassium comprise both organic and inorganic compounds such as the potassium oxides including $K_2O$, $K_2O_2$, $K_2O_3$, and $KO_2$; the potassium carbonates including $K_2CO_3$, potassium hydrogen carbonate, potassium trithiocarbonate, potassium peroxy-carbonate; potassium sulfate including $K_2SO_4$, potassium hydrogen sulfate, potassium ethyl sulfate, potassium phenyl sulfate, potassium propyl sulfate, potassium pyrosulfate, potassium fluosulfonate, potassium methyl sulfate, potassium thiosulfate, potassium peroxydisulfate; potassium sulfides including $K_2S$, KHS, potassium disulfide, potassium trisulfide, $KHSO_3$, potassium tetrasulfide, potassium pentasulfide; potassium halides and halogen compounds including KF, KCl, KBr, KI, $KHF_2$, $KHCl_2$, $KHBr_2$, $KHI_2$, $KF_3$, $KCl_3$, $KBr_3$, $KI_3$, KIBr, $KClO_3$, $KClO_4$, KClO, $KICl_4$, $KICl_2$, potassium chloroosmate, potassium pentachlorohodite, $KBF_4$, $KIO_3$, $KIO_4$, $KIBr_2$, $K_2SnBr_6$, potassium pentachlorohodite; potassium phosphates such as $K_3PO_4$, potassium phenyl phosphate $K_2HPO_4$, $KPO_3$, potassium pyrophosphate, potassium hexafluorophosphate, $K_2HPO_3$, $KH_2PO_3$, potassium glycerophosphate; other organic and inorganic compounds include potassium saccharate acid, potassium hydrogen succinate, potassium d-tartrate, potassium orthotellurate, potassium thiocyanate, potassium dithionate, potassium trithionate, potassium tetrathionate, potassium pentathionate, potassium acid urate, potassium acetate, potassium acid acetate, potassium amide, potassium acetylsalicylate, potassium azide, potassium ammonium tartrate, $KAuO_2$, potassium benzoate, potassium diborane, potassium dihydroxy diborane, potassium pentaborane, potassium metaborate, potassium tetraborate, potassium pentaborate, potassium peroxyborate, potassium bromate, potassium borotartrate, potassium chromium chromate, potassium citrate, potassium cyanate, potassium cyanide, potassium fluogermanate, potassium fluorescein derivative, potassium picrate, potassium hydrogen phthalate, potassium piperate, potassium propionate, potassium salicylate, potassium santoninate, potassium stearate, potassium succinate, potassium fluothorate, potassium fluotitanate, potassium formate, potassium hydride, KOH, potassium lactate, potassium laurate, potassium malate, potassium methionate, potassium carbonyl, potassium chromate, potassium dichromate, potassium peroxychromate, potassium nitrate, potassium nitride, potassium nitrite, potassium oleate, potassium osmate, potassium oxalate, and potassium hydrogen oxalate.

Likewise, the corresponding compounds of other alkali metals such as sodium and lithium as well as cesium and rubidium may be used as sources of the respective ion, e.g., sodium, lithium, cesium, and rubidium.

Thus, the cesium source can be elemental cesium or a cesium compound similar to the K compounds noted hereinbefore. Examples, not by way of limitation of cesium compounds, include both organic and inorganic compounds as $CsC_2H_3O_2$ (cesium acetate), $CsC_7H_5O_2$ (cesium benzoate), $CsBrO_3$ (cesium bromate), CsBr (cesium monobromide), $CsBr_3$ (cesium tribromide), CsBrClI (cesium bromochloroiodide), $CsIBr_2$ (cesium dibromoiodide), $CsI_2Br$ (cesium bromodiiodide), $Cs_2CO_3$ (cesium carbonate), $CsHCO_3$ (cesium carbonate hydrogen), $CsClO_3$ (cesium chlorate), $CsClO_4$ (cesium perchlorate), CsCl (cesium chloride), $CsAuCl_4$ (cesium chloroaurate), $CsBr_2Cl$ (cesium chlorodibromide), $CsBrCl_2$ (cesium dichlorobromide), $CsICl_2$ (cesium dichloroiodide), $Cs_2SnCl_6$ (cesium chlorostannate), $Cs_2CrO_4$ (cesium chromate), CsCn (cesium cyanide), CsF (cesium fluoride), $CsCHO_2$ (cesium formate), $CsCHO.H_2O$, CsH (cesium hydride), CsOH (cesium hydroxide), $CsIO_3$ (cesium iodate), $CsIO_4$ (cesium metaperiodate), CsI (cesium monoiodide), $CsI_3$ (cesium triiodide), $CsI_5$ (cesium pentaiodide), $CsCl_5$, $CsBr_5$, $CsF_5$, $CSNO_3$ (cesium nitrate), $CsNO_3.HNO_3$ (cesium hydrogen nitrate), $CsNO_3.2HNO_3$ (cesium dihydrogen nitrate), $CsNO_2$ (cesium nitrite), $Cs_2C_2O_4$ (cesium oxalate), $Cs_2O$ (cesium monoxide), $Cs_2O_2$ (cesium peroxide), $Cs_2O_3$ (cesium trioxide), $CsO_2$ (cesium superoxide), $CsHC_8H_4O_4$ (cesium hydrogen phthalate), $CsRh(SO_4)_2.12H_2O$ (cesium rhodium sulfate), $CsC_7H_5O_3$ (cesium salicylate), $Cs_2SO_4$ (cesium sulfate), $CsHSO_4$ (cesium hydrogen sulfate), $Cs_2S.4H_2O$ (cesium sulfide), $Cs_2S_2$ (cesium disulfide), $Cs_2S_2.H_2O$, $Cs_2S_3$ (cesium tetrasulfide), $Cs_2S_5$ (cesium pentasulfide), $Cs_2S_6$ (cesium hexasulfide).

The rubidium source can be elemental rubidium or a rubidium compounds, e.g., similar to the potassium and cesium compounds noted hereinbefore. Examples, not by way of limitation of rubidium compounds, include both organic and inorganic compounds such as $RbC_2H_3O_2$ (rubidium acetate), $RbAl(SO_4)_2.12H_2O$ (rubidium aluminum sulfate), $RbBrO_3$ (rubidium bromate), RbBr (rubidium bromide), $RbBr_3$ (rubidium tribromide), RbIBrCl (rubidium bromochloroiodide), $RbIBr_2$ (rubidium dibromoiodide), $RbBrCl_2$ (rubidium dichlorobromide), $RbBr_2Cl$ (rubidium chlorodibromide), $Rb_2CO_3$ (rubidium carbonate), $RbHCO_3$, $RbClO_3$ (rubidium chlorate), $RbClO_4$ (rubidium perchlorate), RbCl (rubidium chloride), $RbICl_2$ (rubidium dichloroiodide), $Rb_2CrO_4$ (rubidium chromate), $Rb_2Cr_2O_7$ (rubidium dichromate), RbF (rubidium fluoride), $Rb_2SiF_6$ (rubidium fluosilicate), $RbFSO_3$ (rubidium fluosulfonate), RbH (rubidium hydride), RbOH (rubidium hydroxide), $RbL)_3$ (rubidium iodate), $RbIO_4$ (ribidium metaperiodate)$_3$, RbI (rubidium iodide), $RbI_3$ (rubidium triiodide), $RbI._4SO_2$, $RbMnO_4$ (rubidium permanganate), $RbNO_3$ (rubidium nitrate), $RbNO_3.HNO_3$ (rubidium hydrogen nitrate), $RbNO_3.2HNO_3$, $Rb_2O$ (rubidium superoxide), $Rb_2SO_4$ (rubidium sulfate), $RbHSO_4$ (rubidium hydrogen sulfate), $Rb_2S$ (rubidium monosulfide), $Rb_2S.4H_2O$, $Rb_2S_2$ (rubidium disulfide), $Rb_2S_3$ (rubidium trisulfide), $Rb_2S_5$ (rubidium pentasulfide), $Rb_2S_6$ (rubidium hexasulfide), $RbHC_4H_4O_6$, $Rb_2O_2$ (rubidium peroxide).

Specific sources of sodium or lithium ion would include elemental sodium and lithium as well as compounds of all the classes listed for potassium, cesium, and rubidium hereinbefore, particularly the oxides and carbonates.

Likewise, alloys or ceramics containing one or more of the Group IA elements may be employed.

Specific sources of the Group IIA metals include the metals in an elemental state as well as organic and inorganic compounds including the acetates, amides, borides, bromates, halides (including chlorides, iodides, bromides, fluorides), oxyhalides, carbonates, chlorates, chromates, citrates, hydrides, sulfides, sulfates, hypochlorites, nitrates, nitrites, oxides, silicates, aluminates of beryllium, magnesium, calcium, barium, and strontium.

As already noted the Group IA or IIA element is selectively enriched into the dielectric before curing in a small effective amount sufficient to provide stable operating voltages over a given period of panel operating time. Typically, the Group IA or IIA element is selectively added into the uncured dielectric in a quantity of about 0.5% to about 8% by weight in the oxide state of the element based on the total weight of the dielectric composition before curing. Preferably the quantity of element selectively added into the dielectric before curing is about 1% to about 4% by weight of the element in the oxide state.

In the fabrication of a gaseous discharge panel, the dielectric material is typically applied and cured on the surface of a glass substrate. When the glass substrate contains significant amounts of Group IA or IIA elements, an ion exchange, migration, diffusion, or other reaction effect may take place thereby adding to the total amount of Group IA or IIA previously incorporated in the dielectric, e.g., added as an oxide or carbonate to the dielectric batch. Such additional amounts, present after the dielectric is cured in contact with the substrate, are not included in the above quantity ranges. Thus, it is contemplated that the substrate glass may be the partial source of the Group IA or IIA element in the cured dielectric by means of an ion exchange, migration, diffusion, or other reaction process.

The amount of Group IA or IIA oxide transferred from the substrate to the cured dielectric is a function of the dielectric curing temperature, the time period of heating, the amount and kind of Group IA or IIA oxide in the substrate and dielectric before curing, and other variables. In any event, the amount of Group IA or IIA oxide transferred from the substrate to the cured dielectric is less than about 5 percent by weight based on the total weight of the cured dielectric. This transferred amount is not considered in the range of selectively added Group IA or IIA element; that is, any Group IA or IIA oxide transferred from the substrate to the dielectric is in addition to the Group IA or IIA oxide selectively added to the uncured dielectric.

Depending upon the specific Group IA or IIA element or combinations thereof utilized, the practice of this invention has been found to be especially beneficial over given periods of operating time. Best results are typically realized after appropriate aging of the panel, the required amount of aging being a function of the specific Group IA or IIA members incorporated into the panel dielectric material. As used herein, panel aging is defined as total or accumulated panel operating time.

Tables II to IX are presented hereafter as working examples and best embodiments contemplated by the inventor for the practice of this invention. Table I represents a standard or prior art dielectric not prepared in accordance with this invention. In each table the dielectric composition is given before and after curing.

In the preparation of the standard dielectric of Table I, no Group IA or IIA element was added to the uncured dielectric. In the dielectrics of Tables II to IX varying amounts (within the 0.5 to 8 wt. % range) were added to the uncured dielectric compositions. The dielectric curing conditions for all compositions (I to IX) were about the same, 1125° F. curing temperature for about 30 minutes.

A gas discharge device utilizing the standard dielectric of Table I exhibited operating voltage changes of about 10 volts whereas the dielectrics of Tables II to IX exhibited significantly less voltage changes. This is illustrated by FIG. 1 of the drawing which plots the results of Tables I, II, III, and IV.

More specifically, there is shown in FIG. 1 four separate dielectric curves on a plot of change in voltage ($\Delta v$) versus accumulated panel operating time in hours. All curves illustrate that a minimum amount of aging, e.g., up to about 300 hours, is required for any particular dielectric compositions. Thereafter the performance of II, III, and IV in terms of less voltage change is improved relative to I (the standard dielectric).

TABLE I

| | Standard Dielectric Composition | |
|---|---|---|
| Component | Before Cure | After Cure |
| $SiO_2$ | 13.43 wt. % | 15.50 wt. % |
| PbO | 73.40 | 69.90 |
| $B_2O_3$ | 13.20 | 12.63 |
| $Na_2O$ | 0.005 | 1.26 |
| CaO | — | 0.59 |
| | 100.03 wt. % | 99.88 wt. % |

TABLE II

| | 1.88% wt. % Sodium Oxide Added to Dielectric Composition Before Cure | |
|---|---|---|
| Component | Before Cure | After Cure |
| $SiO_2$ | 13.3 wt. % | 14.25 wt. % |
| PbO | 71.80 | 68.90 |
| $B_2O_3$ | 12.81 | 12.56 |
| $Na_2O$ | 1.88 | 2.50 |
| CaO | — | 0.39 |
| | 99.62 wt. % | 98.60 wt. % |

TABLE III

| | 3.63 wt. % Sodium Oxide Added to Dielectric Composition Before Cure | |
|---|---|---|
| Component | Before Cure | After Cure |
| $SiO_2$ | 13.22 wt. % | 17.75 wt. % |
| $B_2O_3$ | 13.05 | 12.28 |
| PbO | 69.95 | 64.30 |

TABLE III-continued

| Component | 3.63 wt. % Sodium Oxide Added to Dielectric Composition Before Cure | |
|---|---|---|
| | Before Cure | After Cure |
| $Na_2O$ | 3.63 | 4.86 |
| CaO | — | 0.84 |
| | 99.85 wt. % | 100.03 wt. % |

TABLE IV

| Component | .97 wt. % $Cs_2O$ Added To Dielectric Composition Before Cure | |
|---|---|---|
| | Before Cure | After Cure |
| $SiO_2$ | 13.30 wt. % | 14.05 wt. % |
| PbO | 72.75 | 71.50 |
| $B_2O_3$ | 12.87 | 12.80 |
| $Na_2O$ | 0.04 | 0.67 |
| $Cs_2O$ | 0.97 | 0.98 |
| CaO | — | 0.34 |
| | 99.93 wt. % | 100.34 wt. % |

TABLE V

| Component | 7.98 wt. % $Cs_2O$ Added To Dielectric Composition Before Cure | |
|---|---|---|
| | Before Cure | After Cure |
| $SiO_2$ | 12.48 wt. % | 13.67 wt. % |
| $B_2O_3$ | 12.14 | 11.97 |
| PbO | 66.85 | 64.20 |
| $Na_2O$ | 0.026 | 0.80 |
| $Cs_2O$ | 7.98 | 8.20 |
| CaO | — | 0.46 |
| | 99.48 wt. % | 99.30 wt. % |

TABLE VI

| Component | 2.32 wt. % CaO Added To Dielectric Composition Before Cure | |
|---|---|---|
| | Before Cure | After Cure |
| $SiO_2$ | 13.33 wt. % | 14.67 wt. % |
| PbO | 71.65 | 68.20 |
| $B_2O_3$ | 12.85 | 12.65 |
| $Na_2O$ | 0.009 | 0.867 |
| CaO | 2.32 | 2.69 |
| | 100.15 wt. % | 99.08 wt. % |

TABLE VII

| Component | 5.41 wt. % CaO Added To Dielectric Composition Before Cure | |
|---|---|---|
| | Before Cure | After Cure |
| $SiO_2$ | 12.52 wt. % | 14.19 wt. % |
| PbO | 70.20 | 67.25 |
| $B_2O_3$ | 11.90 | 11.79 |
| $Na_2O$ | 0.014 | 0.80 |
| CaO | 5.41 | 5.64 |
| | 100.03 wt. % | 99.67 wt. % |

TABLE VIII

| Component | 3.76 wt. % MgO Added To Dielectric Composition Before Cure | |
|---|---|---|
| | Before Cure | After Cure |
| $SiO_2$ | 13.21 wt. % | 14.70 wt. % |
| PbO | 70.75 | 66.85 |
| $B_2O_3$ | 12.55 | 12.90 |
| $Na_2O$ | 0.007 | 1.00 |
| MgO | 3.76 | 3.86 |
| CaO | — | 0.32 |
| | 100.27 wt. % | 99.63 wt. % |

TABLE IX

| Component | 0.89 wt. % $Li_2O$ Added To Dielectric Composition Before Cure | |
|---|---|---|
| | Before Cure | After Cure |
| $SiO_2$ | 13.47 wt. % | 16.40 wt. % |
| $B_2O_3$ | 12.76 | 12.36 |

TABLE IX-continued

| Component | 0.89 wt. % $Li_2O$ Added To Dielectric Composition Before Cure | |
|---|---|---|
| | Before Cure | After Cure |
| PbO | 72.20 | 66.90 |
| $Na_2O$ | 0.0068 | 2.89 |
| $Li_2O$ | 0.89 | 0.007 |
| CaO | — | 0.56 |
| | 99.32 wt. % | 99.11 wt. % |

Reference is made to the following detailed description of FIGS. 2 to 5 of the drawings.

Figure 3:
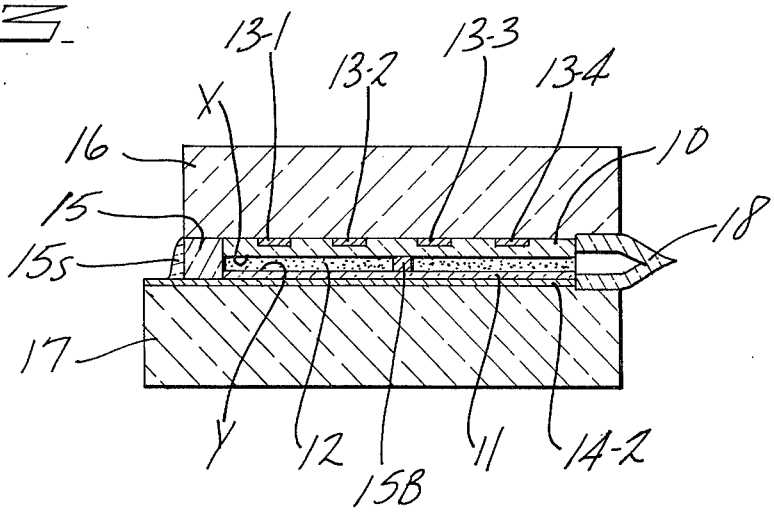
Figure 2:
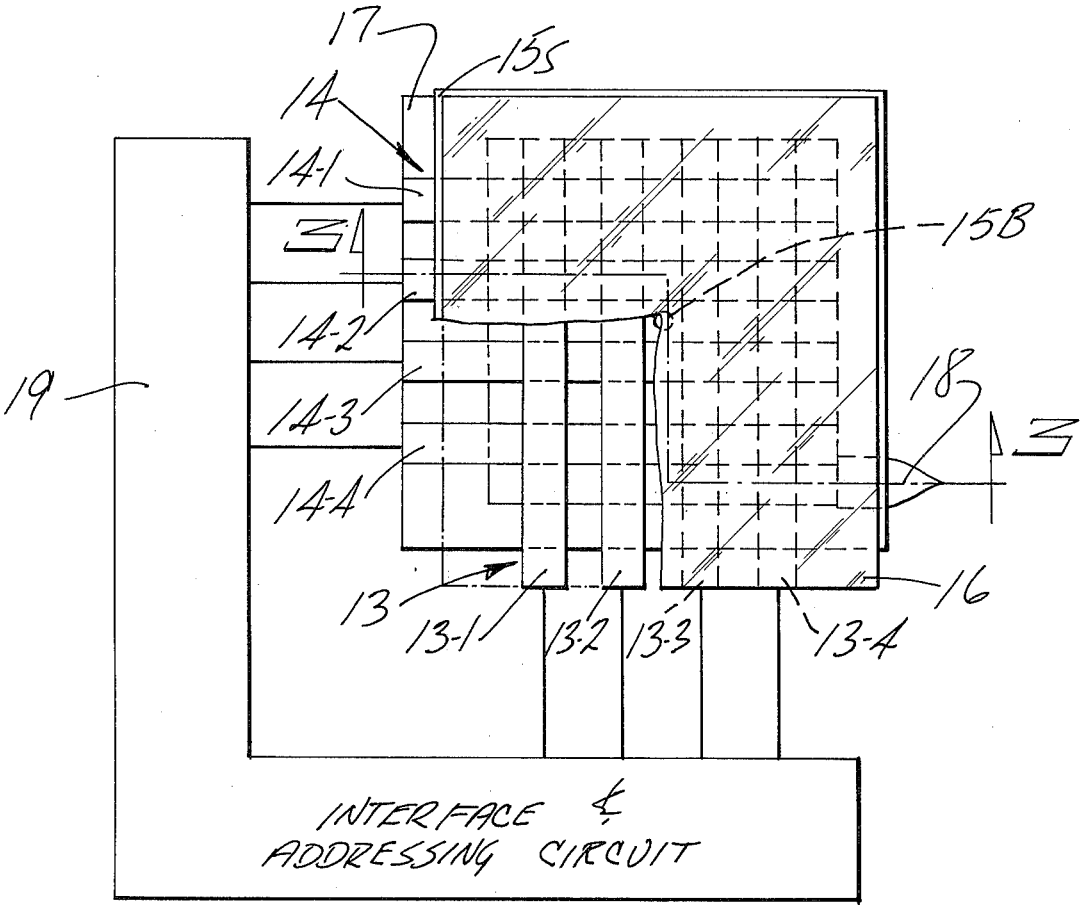
Figure 4:
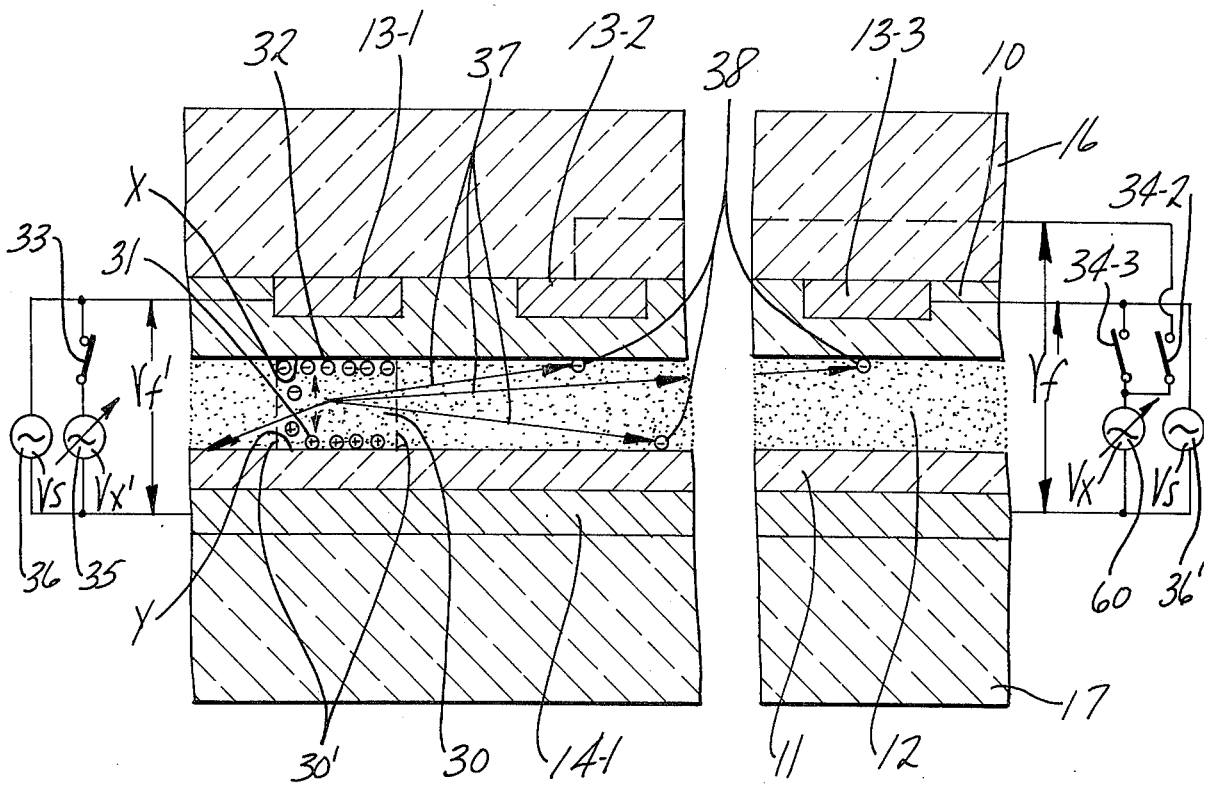
Figure 5:
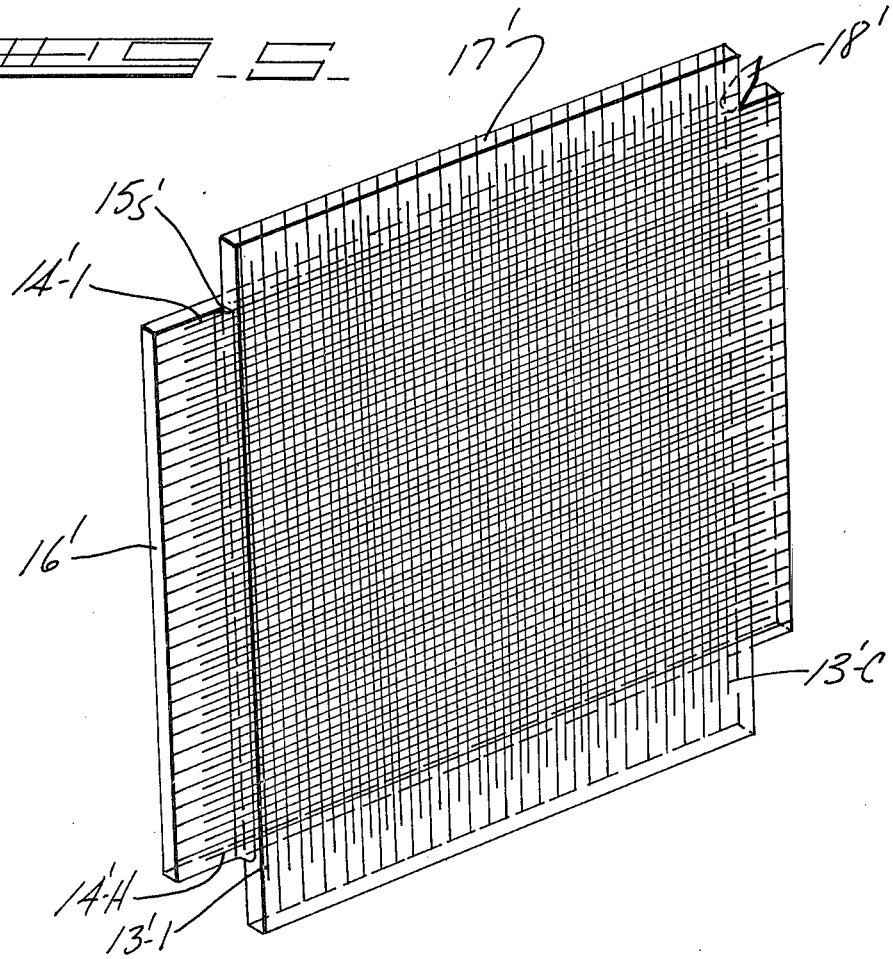

FIG. 2 is a partially cut-away plan view of a gaseous discharge display/memory panel as connected to a diagrammatically illustrated source of operating potentials, FIG. 3 is a cross-sectional view (enlarged, but not to proportional scale since the thickness of the gas volume, dielectric members and conductor arrays have been enlarged for purposes of illustration) taken on lines 2 — 2 of FIG. 2, FIG. 4 is an explanatory partial cross-sectional view similar to FIG. 3 (enlarged, but not to proportional scale), FIG. 5 is an isometric view of a gaseous discharge display/memory panel.

The invention utilizes a pair of dielectric films 10 and 11 separated by a thin layer or volume of a gaseous discharge medium 12, the medium 12 producing a copious supply of charges (ions and electrons) which are alternately collectable on the surfaces of the dielectric members at opposed or facing elemental or discrete areas X and Y defined by the conductor matrix on non-gas-contacting sides of the dielectric members, each dielectric member presenting large open surface areas and a plurality of pairs of elemental X and Y areas. While the electrically operative structural members such as the dielectric members 10 and 11 and conductor matrixes 13 and 14 are all relatively thin (being exaggerated in thickness in the drawings) they are formed on and supported by rigid nonconductive support members 16 and 17 respectively.

Preferably, one or both of nonconductive support members 16 and 17 pass light produced by discharge in the elemental gas volumes. Preferably, they are transparent glass members and these members essentially define the overall thickness and strength of the panel. For example, the thickness of gas layer 12 as determined by spacer 15 is usually under 10 mils and preferably about 4 to 6 mils, dielectric layers 10 and 11 (over the conductors at the elemental or discrete X and Y areas) are usually between 1 and 2 mils thick, and conductors 13 and 14 about 8,000 angstroms thick. However, support members 16 and 17 are much thicker (particularly in larger panels) so as to provide as much ruggedness as may be desired to compensate for stresses in the panel. Support members 16 and 17 also serve as heat sinks for heat generated by discharges and thus minimize the effect of temperature on operation of the device. If it is desired that only the memory function be utilized, then none of the members need be transparent to light.

Except for being nonconductive or good insulators the electrical properties of support members 16 and 17 are not critical. The main function of support members 16 and 17 is to provide mechanical support and strength for the entire panel, particularly with respect to pressure differential acting on the panel and thermal shock. As noted earlier, they should have thermal expansion characteristics substantially matching the thermal expansion characteristics of dielectric layers 10 and 11. Ordinary ¼ inch commercial grade soda lime plate glasses have been used for this purpose. Other glasses such as low expansion glass or transparent devitrified glass can be used provided they can withstand processing and have expansion characteristics substantially matching expansion characteristics of the dielectric coatings 10 and 11. For given pressure differentials and thickness of plates, the stress and deflection of plates may be determined by following standard stress and strain formulas (see R. J. Roark, *Formulas for Stress and Strain,* McGraw-Hill, 1954).

Spacer 15 may be made of the same glass material as dielectric films 10 and 11 and may be an integral rib formed on one of the dielectric members and fused to the other members to form a bakeable hermetic seal enclosing and confining the ionizable gas volume 12. However, a separate final hermetic seal may be effected by a high strength devitrified glass sealant 15S. Tubulation 18 is provided for exhausting the space between dielectric members 10 and 11 and filling that space with the volume of ionizable gas. For large panels small beadlike solder glass spacers such as shown at 15B may be located between conductor intersections and fused to dielectric members 10 and 11 to aid in withstanding stress on the panel and maintain uniformity of thickness of gas volume 12.

Conductor arrays 13 and 14 may be formed on support members 16 and 17 by a number of well-known processes, such as photoetching, vacuum deposition, stencil screening, etc. In the panel shown in FIG. 5, the center-to-center spacing of conductors in the respective arrays is about 17 mils. Transparent or semi-transparent conductive material such as tin oxide, gold or aluminum can be used to form the conductor arrays and should have a resistance less than 3000 ohms per line. Narrow opaque electrodes may alternately be used so that discharge light passes around the edges of the electrodes to the viewer. It is important to select a conductor material that is not attacked during processing by the dielectric material.

It will be appreciated that conductor arrays 13 and 14 may be wires or filaments of copper, gold, silver or aluminum or any other conductive metal or material. For example 1 mil wire filaments are commercially available and may be used in the invention. However, formed in situ conductor arrays are preferred since they may be more easily and uniformly placed on and adhered to the support plates 16 and 17.

Dielectric layer members 10 and 11 are formed of an inorganic material and are preferably formed in situ as an adherent film or coating which is not chemically or physically effected during bake-out of the panel. One such material is a solder glass such as Kimble SG-68 manufactured by and commercially available from the assignee of the present invention.

This glass has thermal expansion characteristics substantially matching the thermal expansion characteristics of certain soda-lime glasses, and can be used as the dielectric layer when the support members 16 and 17 are soda-lime glass plates. Dielectric layers 10 and 11 must be smooth and have a dielectric strength of about 1000 v. and be electrically homogeneous on a microscopic scale (e.g., no cracks, bubbles, crystals, dirt, surface films, etc.). In addition, the surfaces of dielectric layers 10 and 11 should be good photoemitters of electrons in a baked out condition. Alternatively, dielectric layers 10 and 11 may be overcoated with materials designed to produce good electron emission, as in U.S. Letters Pat. No. 3,634,719, issued to Roger E. Ernsthausen. Of course, for an optical display at least one of dielectric layer 10 and 11 should pass light generated on discharge and be transparent or translucent and, preferably, both layers are optically transparent.

The preferred spacing between surfaces of the dielectric films is about 4 to 6 mils with conductor arrays 13 and 14 having center-to-center spacing of about 17 mils.

The ends of conductors 14-1 . . . 14-4 and support member 17 extend beyond the enclosed gas volume 12 and are exposed for the purpose of making electrical connection to interface and addressing circuitry 19. Likewise, the ends of conductors 13-1 . . . 13-4 on support member 16 extend beyond the enclosed gas volume 12 and are exposed for the purpose of making electrical connection to interface and addressing circuitry 19.

As in known display systems, the interface and addressing circuitry or system 19 may be relatively inexpensive line scan systems or the somewhat more expensive high speed random access systems. In either case, it is to be noted that a lower amplitude of operating potentials helps to reduce problems associated with the interface circuitry between the addressing systems and the display/memory panel, per se. Thus, by providing a panel having greater uniformity in the discharge characteristics throughout the panel, tolerances and operating characteristics of the panel with which the interfacing circuitry cooperate, are made less rigid.

I claim:

1. As an article of manufacture, a dielectric charge storage body for a gaseous discharge panel, said dielectric body being selectively enriched with at least one element selected from the group consisting of lithium, sodium, potassium, cesium, beryllium, magnesium, calcium, strontium and barium in an amount sufficient to provide gas discharge device operating voltages which are substantially uniform and which do not significantly change with time after a period of aging.

2. The invention of claim 1 wherein said dielectric body is selectively enriched with about 0.5 weight percent to about 8 weight percent of said element in the oxide state based on the total weight of the dielectric body.

3. The invention of claim 1 wherein said dielectric body is selectively enriched with about 1 weight percent to about 4 weight percent of said element in the oxide state based on the total weight of the dielectric body.

4. As an article of manufacture, a dielectric material body for a gaseous discharge panel, said dielectric body being selectively enriched with at least one element selected from the group consisting of lithium, sodium, potassium, cesium, beryllium, magnesium, calcium, strontium and barium in an amount sufficient to provide gas discharge device operating voltages which are substantially uniform and which do not significantly change with time after a period of aging, and said body having a gas contacting charge storage side surface and an electrode contacting side surface.

5. The invention of claim 4 wherein said dielectric body is selectively enriched with about 0.5 weight percent to about 8 weight percent of said element in the oxide state based on the total weight of the dielectric body.

6. The invention of claim 5 wherein said dielectric body is selectively enriched with about 1 weight percent to about 4 weight percent of said element in the oxide state based on the total weight of the dielectric body.

* * * * *